US011505844B2

(12) United States Patent
Zhou et al.

(10) Patent No.: US 11,505,844 B2
(45) **Date of Patent: *Nov. 22, 2022**

(54) COLD-ROLLED HIGH-STRENGTH STEEL PLATE HAVING EXCELLENT PHOSPHATING PERFORMANCE AND FORMABILITY AND MANUFACTURING METHOD THEREFOR

(71) Applicant: BAOSHAN IRON & STEEL CO., LTD., Shanghai (CN)

(72) Inventors: Shu Zhou, Shanghai (CN); Yong Zhong, Shanghai (CN); Xinyan Jin, Shanghai (CN); Li Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 385 days.

This patent is subject to a terminal disclaimer.

(21) Appl. No.: 16/328,991

(22) PCT Filed: Aug. 29, 2017

(86) PCT No.: PCT/CN2017/099421

§ 371 (c)(1),
(2) Date: Feb. 27, 2019

(87) PCT Pub. No.: WO2018/041089

PCT Pub. Date: Mar. 8, 2018

(65) Prior Publication Data

US 2019/0194774 A1 Jun. 27, 2019

(30) Foreign Application Priority Data

Aug. 30, 2016 (CN) ..... 201610771232.6

(51) Int. Cl.
*C21D 9/46* (2006.01)
*C21D 1/74* (2006.01)
(Continued)

(52) U.S. Cl.
CPC ..... *C21D 9/46* (2013.01); *C21D 1/26* (2013.01); *C21D 1/74* (2013.01); *C21D 6/002* (2013.01);
(Continued)

(58) Field of Classification Search
CPC ..... C21D 8/0263; C21D 8/02; C21D 8/0205; C21D 8/0226; C21D 8/0236;
(Continued)

(56) References Cited

U.S. PATENT DOCUMENTS

2013/0236740 A1* 9/2013 Kojima ..... C23C 2/28 427/372.2
2014/0287263 A1* 9/2014 Kawata ..... B32B 15/013 428/659
(Continued)

FOREIGN PATENT DOCUMENTS

CN 103805838 5/2014
CN 103805840 5/2014
(Continued)

OTHER PUBLICATIONS

Korean Office Action dated Jun. 1, 2020 for Korean Patent Application No. 20197005612, and English translation of the Office Action.

(Continued)

*Primary Examiner* — John A Hevey
(74) *Attorney, Agent, or Firm* — Lei Fang, Esq.; Smith Tempel Blaha LLC

(57) ABSTRACT

A cold-rolled steel plate (1) and a manufacturing method therefor. The chemical composition of the steel plate (1) in
(Continued)

percentage by weight is: C 0.15-0.25%, Si 1.50-2.50%, Mn 2.00-3.00%, P≤0.02%, S≤0.01%, Al 0.03-0.06%, N≤0.01%, with the balance being Fe and impurities. The surface layer has an inner oxide layer (2) with a thickness of 1-5 μm, and there is no enrichment of Si or Mn on the surface. The steel plate (1) has good phosphating performance and formability, with a tensile strength of ≥1180 MPa and an elongation of ≥14%, and has a complex-phase structure of ferrite, martensite, and retained austenite, the content of the retained austenite being not lower than 5%. A dew point is at −25° C. to 10° C. in continuous annealing, such that external oxidation transitions to internal oxidation.

10 Claims, 3 Drawing Sheets

(51) Int. Cl.

| | |
|---|---|
| ***C21D 1/26*** | (2006.01) |
| ***C22C 38/02*** | (2006.01) |
| ***C22C 38/04*** | (2006.01) |
| ***C22C 38/06*** | (2006.01) |
| ***C21D 8/02*** | (2006.01) |
| ***C21D 6/00*** | (2006.01) |
| ***C22C 38/00*** | (2006.01) |
| ***C22C 38/12*** | (2006.01) |
| ***C22C 38/14*** | (2006.01) |
| ***C22C 38/22*** | (2006.01) |
| ***C22C 38/28*** | (2006.01) |
| ***C22C 38/38*** | (2006.01) |

(52) U.S. Cl.
CPC ..... *C21D 6/005* (2013.01); *C21D 6/008* (2013.01); *C21D 8/02* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/28* (2013.01); *C22C 38/38* (2013.01); *C21D 2211/001* (2013.01); *C21D 2211/005* (2013.01); *C21D 2211/008* (2013.01)

(58) Field of Classification Search
CPC ..... C21D 2211/002; C21D 2211/008; C21D 1/74; C21D 8/0247; C21D 2211/001; C21D 2211/005; C22C 38/001; C22C 38/02; C22C 38/04; C22C 38/06
See application file for complete search history.

(56) References Cited

U.S. PATENT DOCUMENTS

| | | | | |
|---|---|---|---|---|
| 2015/0337416 | A1* | 11/2015 | Zhong | C21D 9/46 148/320 |
| 2018/0312954 | A1* | 11/2018 | Yasui | C22C 38/32 |
| 2019/0194770 | A1* | 6/2019 | Zhou | C22C 38/02 |

FOREIGN PATENT DOCUMENTS

| | | | | |
|---|---|---|---|---|
| CN | 106244923 | | 12/2016 | |
| EP | 2813595 | | 12/2014 | |
| EP | 2921568 | | 9/2015 | |
| JP | H06256965 | | 9/1994 | |
| JP | 2004323969 | | 11/2004 | |
| JP | 3840392 | | 11/2006 | |
| KR | 20150086312 | | 7/2015 | |
| KR | 20150086312 | A * | 7/2015 | C22C 38/04 |
| WO | 2014075405 | | 5/2014 | |
| WO | 2015001367 | | 1/2015 | |
| WO | 2016001705 | | 1/2016 | |

OTHER PUBLICATIONS

European Search Report dated Mar. 6, 2020 for European U.S. Appl. No. 17/845,391.
International Search Report and Written Opinion for PCT Application No. PCT/CN2017/099421.

* cited by examiner

COLD-ROLLED HIGH-STRENGTH STEEL PLATE HAVING EXCELLENT PHOSPHATING PERFORMANCE AND FORMABILITY AND MANUFACTURING METHOD THEREFOR

CROSS-REFERENCE TO RELATED APPLICATIONS

This application is a 371 U.S. National Phase of PCT International Application No. PCT/CN2017/099421 filed on Aug. 29, 2017, which claims benefit and priority to Chinese patent application no. 201610771232.6 filed on Aug. 30, 2016. Both of the above-referenced applications are incorporated by reference herein in their entireties.

TECHNICAL FIELD

The present disclosure pertains to the field of cold-rolled high-strength steel, and particularly relates to a cold-rolled high-strength steel plate having excellent phosphatability and formability and a manufacturing method thereof.

BACKGROUND ART

In recent years, as the requirements of environmental protection laws and collision regulations are becoming higher and higher, a large quantity of 590-980 MPa grade high-strength cold-rolled steel plates have begun to be utilized in automobiles to replace traditional automobile steel, so as to improve the strength and reduce the thickness of the parts of automobile bodies, and achieve the objects of saving energy, reducing weight, improving safety and reducing manufacturing cost.

In order to further improve the effect of weight reduction of automobile bodies, the material strength needs to be further improved. That is, the strength needs to reach 1180 MPa or more. However, as the strength increases, the formability of the steel plate gradually deteriorates. Therefore, it is desired to develop a steel plate having both high strength and high formability.

Generally, a steel plate needs to be coated before used for an automobile, and phosphating treatment is required before coating to form a phosphated film on a surface of the steel plate. A normal phosphated film is characterized by uniformity, density and fine phosphated crystals, thereby improving adhesion of a coating, enhancing electrophoresis effect, and improving corrosion resistance of a coated part. Therefore, phosphating quality directly decides coating quality and corrosion resistance of automobiles, and in turn, influences application of the steel plate in automobiles.

In order to improve both strength and formability of a steel plate, a certain amount of Si is generally added into the steel. However, when a steel plate designed to have high silicon in composition is continuously annealed, the Si element is enriched in a surface of the steel plate to form silicon oxides which hinder uniform reaction in a phosphating process, causing problems such as poor phosphating coverage, large phosphated crystal size, etc. These problems result in deteriorated phosphatability of the steel plate, and substandard coating quality and corrosion resistance, thereby greatly limiting application of the high Si steel plate in automobiles. Therefore, it has always been a big challenge to improve phosphatability and coatability of a high Si cold-rolled high-strength steel plate in use.

Chinese Patent Application CN103154297A discloses a high-strength cold-rolled steel plate and a method of manufacturing the same, wherein the steel plate comprises C: 0.01 to 0.18%, Si: 0.4 to 2.0%, Mn: 1.0 to 3.0%, P: 0.005 to 0.060%, S≤0.01%, Al: 0.001 to 1.0%, N≤0.01%, and a balance of Fe and unavoidable impurities. When the steel plate is continuously annealed in a heating furnace, the dew point of the atmosphere in a zone having a temperature of A ° C. or higher and B ° C. or lower (A: 600≤A≤780, B: 800≤B≤900) is controlled to be −10° C. or higher. After continuous annealing, electrolytic pickling is performed in an aqueous solution containing sulfuric acid. Chinese Patent Application CN103140597A discloses a similar high-strength steel plate and a similar method of manufacturing the high-strength steel plate, but the dew point of the atmosphere having a temperature of 750° C. or higher in the annealing furnace is set to be −40° C. or lower. Both of the above patent applications utilize a pickling process after annealing. This not only increases production cost, but also decreases production efficiency. Moreover, the pickling process itself and the treatment of the waste acid solution also have an undesirable influence on the environment.

Chinese Patent Application CN103124799A discloses a high-strength steel plate and a method of manufacturing the same, the main point of which is that the dew point of the atmosphere in a zone having a temperature of 820° C. or higher and 1000° C. or lower in an annealing furnace during a soaking process is −45° C. or lower, and the dew point of the atmosphere in a zone having a temperature of 750° C. or higher in the annealing furnace during a cooling process is −45° C. or lower. By way of such treatment, the reducing ability of the atmosphere is enhanced, and oxides of oxidizable elements such as Si, Mn and the like which are selectively surface oxidized on a surface of the steel plate can be reduced. However, in real continuous annealing production, it is technically difficult to continuously, steadily control the dew point of the atmosphere equal to or lower than −45° C. Such control not only imposes very high requirements on production equipment and technology, but also has no advantage in production cost.

Chinese Patent Application CN104508155A discloses a high-strength steel plate and a method of manufacturing the same, wherein the chemical composition of the steel plate comprises, based on mass %, C: 0.03 to 0.35%, Si: 0.01 to 0.5%, Mn: 3.6 to 8.0%, Al: 0.01% to 1.0%, P≤0.10%, S≤0.010% and a balance of Fe and unavoidable impurities. When the steel plate is continuously annealed, the maximum temperature of the steel plate is set to 600 to 750° C. in the annealing furnace, the time is 30 seconds to 10 minutes, and the dew point of the atmosphere is set to −10° C. or higher. In this method, the Si content is in the range of 0.01 to 0.5%, but the Mn content is as high as 3.6 to 8.0%. Hence, not only full use of the strengthening effect of the inexpensive Si element cannot be made, but also the high content of Mn has reached the range for special steel. On the one hand, it is disadvantageous in terms of cost; and on the other hand, it brings about a large number of technical problems in steel making, continuous casting and subsequent heat treatment.

Chinese Patent Application CN102666923A discloses a high-strength cold-rolled steel plate and a method of manufacturing the same, wherein the steel plate comprises C: 0.05-0.3%, Si: 0.6-3.0%, Mn: 1.0-3.0%, P≤0.1%, S≤0.05%, Al: 0.01 to 1%, N≤0.01%, and a balance of Fe and unavoidable impurities. When the steel plate is continuously annealed, an oxygen concentration is controlled to fulfil oxidation treatment before annealing. The steel plate is heated for the first time in an atmosphere having an oxygen concentration of 1000 ppm or more until the temperature of the steel plate reaches 630° C. or higher, and then the steel plate is heated for a second time in an atmosphere having an oxygen concentration of less than 1000 ppm until the temperature of the steel plate reaches 700-800° C., such that oxides in an amount of 0.1 g/m$^2$ or more are formed on the surface of the steel plate. Then, annealing is performed using a reducing atmosphere having a dew point of −25° C. or lower and 1-10% $H_2$—$N_2$. In this manufacturing method, an oxidation treatment process step is added before annealing, and the production line needs to be equipped with a corresponding device for concurrent control over the heating temperature and oxygen concentration. This operation is relatively difficult. Most of the existing continuous annealing production lines do not have such a function. In addition, this method utilizes an atmosphere of a high oxygen content to achieve non-selective oxidation of the surface of the steel plate. However, the degree of oxidation reaction is very sensitive to the atmosphere. Hence, it's difficult to guarantee the uniformity of the reaction, and the thickness of the oxide layer and the degree of oxidation tend to be non-uniform. When a reduced iron layer is formed by subsequent reduction reaction, the thickness of the reduced iron layer also tends to be non-uniform, resulting in non-uniform phosphatability of the product.

SUMMARY

An object of the present disclosure is to provide a cold-rolled high-strength steel plate having excellent phosphatability and formability, and a method of manufacturing the same. The steel plate has good phosphatability and formability, and a room temperature structure thereof is a composite structure comprising ferrite, martensite and residual austenite having a tensile strength ≥1180 MPa and an elongation ≥14%, suitable for manufacture of automobile structural parts and safety parts.

To achieve the above object, the technical solution of the present disclosure is as follows: A cold-rolled high-strength steel plate having excellent phosphatability and formability, comprising chemical elements in percentage by mass of: C 0.15 to 0.25%, Si 1.50 to 2.50%, Mn 2.00 to 3.00%, P≤0.02%, S≤0.01%, Al 0.03 to 0.06%, N≤0.01%, and a balance of Fe and unavoidable impurity elements, wherein a surface layer of the steel plate comprises an inner oxide layer having a thickness of 1 to 5 μm; the inner oxide layer comprises iron as a matrix; the matrix comprises oxide particles which are at least one of oxides of Si, composite oxides of Si and Mn; no Si or Mn element is enriched in the surface;

the oxide particles have an average diameter of 50 to 200 nm and an average spacing λ between the oxide particles satisfying the following relationship:

$$A=0.247\times(0.94\times[\mathrm{Si}]+0.68\times[\mathrm{Mn}])^{1/2}\times d$$

$$B=1.382\times(0.94\times[\mathrm{Si}]+0.68\times[\mathrm{Mn}])^{1/2}\times d$$

$$A\leq\lambda\leq B$$

wherein [Si] is the content % of Si in the steel; [Mn] is the content % of Mn in the steel; and d is the diameter of the oxide particles in nm.

Preferably, the oxide particles are at least one of silicon oxide, manganese silicate, iron silicate, and ferromanganese silicate.

Further, the steel plate comprises at least one of Cr 0.01 to 1%, Mo 0.01 to 0.5% and Ni 0.01 to 2.0%.

Still further, the steel plate comprises at least one of Ti 0.005 to 0.5%, Nb 0.005 to 0.5% and V 0.005 to 0.5%.

The room temperature structure of the cold-rolled high-strength steel plate having excellent phosphatability and formability according to the present disclosure comprises a composite structure of ferrite, martensite and residual austenite, wherein the residual austenite has a content of no less than 5%, and the cold-rolled high-strength steel plate has a tensile strength ≥1180 MPa and an elongation ≥14%.

In the compositional design according to the present disclosure:

C: Carbon is a solid solution strengthening element necessary for ensuring strength in steel. It is an austenite stabilizing element. If the C content is too low, the content of residual austenite will be insufficient, and the material strength will be low; and if the C content is too high, the weldability of the steel material will be significantly deteriorated. Therefore, the carbon content is controlled at 0.15-0.25% according to the present disclosure.

Si: Silicon has an effect of improving formability of the steel material while enhancing strength thereof. A large amount of silicon is added in the present disclosure. However, excessive addition of Si will make the steel plate remarkably brittle, and cracking tends to occur at the end portions of the steel plate during cold rolling, thereby decreasing production efficiency. Therefore, the Si content is controlled at 1.50-2.50% according to the present disclosure.

Mn: Manganese increases the stability of austenite. At the same time, it reduces the critical cooling temperature and the martensitic transformation temperature Ms during steel quenching, and improves hardenability of the steel plate. In addition, Mn is a solid solution strengthening element, which is advantageous for improving the strength of the steel plate. Therefore, it needs to be added in a large amount according to the present disclosure. However, an excessively high Mn content will cause cracking of a steel slab in a continuous casting process, and affects weldability of the steel material. Therefore, the Mn content is controlled at 2.00-3.00% according to the present disclosure.

P: Phosphorus is an impurity element in the present disclosure. It deteriorates weldability, increases cold brittleness of the steel, and lowers plasticity of the steel. Therefore, it is necessary to control P to be 0.02% or less.

S: Sulfur is also an impurity element. It deteriorates weldability, and lowers plasticity of the steel. Therefore, it is necessary to control S to be 0.01% or less.

Al: Aluminum is added for deoxygenation of molten steel. If the Al content is too low, the purpose of deoxygenation cannot be achieved; if the Al content is too high, the deoxygenating effect will be saturated. Therefore, the Al content is controlled at 0.03-0.06% according to the present disclosure.

N: Nitrogen is an impurity contained in crude steel. N combines with Al to form AlN particles, which affects ductility and thermoplasticity of a steel plate. Therefore, it is desirable to control as far as possible the N content to be 0.01% or less in a steelmaking process.

Cr: Chromium helps to refine austenite grains. Meanwhile, it increases the hardenability and strength of the steel plate. Therefore, Cr may be added suitably to achieve a high strength. However, the Cr content should not be too high. If the Cr content exceeds 1.0%, the cost of the steel plate will be increased, and the weldability will become poor. Therefore, the Cr content is controlled at 0.01-1.0% in the present disclosure.

Mo: Molybdenum can increase the hardenability of the steel plate, and further increase the strength of the steel plate. Mo may be added suitably to ensure the hardenability of the steel plate. However, if the Mo content exceeds 0.5%, the plasticity of the steel plate will decrease significantly, and the production cost will increase. Therefore, the Mo content is controlled in the range of 0.01-0.5% according to the present disclosure.

Ni: Ni has a function similar to that of Mo. It's also an element for increasing the hardenability of the steel plate. Ni may be added suitably to ensure that the tensile strength should reach 1180 MPa or higher. However, the Ni content should not be too high. If the Ni content exceeds 2.0%, the production cost of the steel plate will increase. Therefore, the Ni content is controlled at 0.01-2.0%.

Ti: Ti forms precipitates with C, S and N to effectively increase the strength and toughness of the steel plate. The Ti content needs to be 0.005% or higher to achieve the above effects. On the other hand, if the Ti content exceeds 0.05%, further increase of its content will not have a significant effect in improving the steel. Therefore, the Ti content is designed to be 0.005-0.05% in the present disclosure.

Nb: Nb strengthens the steel by precipitation strengthening. Meanwhile, it prevents growth of austenite grains and refines crystal grains. Hence, it increases strength and elongation at the same time. If the Nb content is less than 0.005%, the above effects cannot be achieved. However, if the Nb content exceeds 0.1%, the precipitation strengthening effect will overact, resulting in a decrease in formability and an increase in manufacturing cost. Therefore, in the present disclosure, the Nb content is controlled in the range of 0.005-0.1%.

V: Similar to Nb, V functions to form carbides and improve the steel strength. If the V content is less than 0.005%, its precipitation strengthening effect will be insignificant. However, if the V content is greater than 0.1%, the precipitation strengthening effect will overact, resulting in a decrease in the formability of the steel plate. Therefore, in the present disclosure, the V content is controlled at 0.005-0.1%.

The surface layer of the cold-rolled high-strength steel plate of the present disclosure comprises an inner oxide layer having a thickness of 1-5 μm, and the inner oxide layer comprises oxide particles, wherein the oxide particles are one or more of oxides of Si and composite oxides of Si and Mn. It's necessary for the surface layer of the steel plate of the present disclosure to be characterized by an inner oxide layer having a certain thickness. This is inextricably linked with the high Si and Mn contents in the steel plate, and ensures that the Si element will not be enriched in the surface of the steel plate to form Si oxides, such that the oxidation reaction turns from external oxidation into internal oxidation, thereby improving phosphatability of the steel plate.

In the cold-rolled high-strength steel plate of the present disclosure, the thickness of the inner oxide layer, the size of the oxide particles and the density of the oxide particles directly influence the function of the inner oxide layer to improve the surface state of the steel plate. The oxide density may be represented by an average spacing λ between the oxide particles, which is related to the Si, Mn contents and oxide particle diameter as follows: the average spacing λ between the oxide particles satisfies the following relationship:

$$A=0.247\times(0.94\times[Si]+0.68\times[Mn])^{1/2}\times d$$

$$B=1.382\times(0.94\times[Si]+0.68\times[Mn])^{1/2}\times d$$

$$A\leq\lambda\leq B$$

wherein [Si] is the content % of Si in the steel; [Mn] is the content % of Mn in the steel; and d is the diameter of the oxide particles in nm. When the thickness of the inner oxide layer is <1 μm, the average diameter of the Si oxide particles is <50 nm and the average spacing is λ>B, the inner oxide layer cannot prevent Si from being enriched toward the surface of the steel plate, and a large amount of oxide particles will still be formed in the surface of the steel plate. In this case, external oxidation cannot be effectively suppressed, and these oxide particles in the surface of the steel plate will seriously hinder uniform reaction of a phosphating process, causing problems such as surface yellow rusting, poor phosphating, large phosphated crystal size and the like.

When the thickness of the inner oxide layer is >5 μm, the average diameter of the Si oxide particles is >200 nm and the average spacing is λ<A, the internal oxidation is too strong, which has a significant influence on the toughness and formability of the steel plate. Therefore, in order to ensure good phosphatability of the steel plate, the thickness of the inner oxide layer in the surface layer of the steel plate is controlled to be 1-5 μm, the average diameter of the oxide particles is controlled to be 50-200 nm, and the average spacing λ between the oxide particles is controlled to be between A and B.

The room temperature structure of the cold-rolled high-strength steel plate of the present disclosure comprises residual austenite, and the content of the residual austenite is not less than 5%. During a deformation process, a certain amount of the residual austenite undergoes phase change and transforms into martensite, and the TRIP effect occurs, ensuring that the steel plate should have good formability while having a strength of 1180 MPa. If the residual austenite content is <5%, the TRIP effect will be insignificant, and high strength and formability of the steel plate cannot be guaranteed. Therefore, it's desirable to ensure that the residual austenite content in the room temperature structure is ≥5%.

The present disclosure further provides a method of manufacturing the cold-rolled high-strength steel plate having excellent phosphatability and formability, comprising the following steps:

1) Smelting and Casting

Smelting and casting according to the above chemical composition to form a slab;

2) Hot Rolling and Coiling

Heating the slab to 1170-1300° C.; holding for 0.5-4 h; rolling, with a final rolling temperature ≥850° C.; and coiling at a coiling temperature of 400-700° C. to obtain a hot rolled coil;

3) Pickling and Cold Rolling

Uncoiling the hot rolled coil, pickling at a speed ≤150 m/min, and cold rolling with a cold rolling reduction of 40-80% to obtain a rolled hard strip steel;

4) Continuous Annealing

Uncoiling the resulting rolled hard strip steel, cleaning, heating to a soaking temperature of 790-920° C., and holding for 30-200 s, wherein a heating rate is 1-20° C./s, and an atmosphere of the heating and holding stage is a $N_2$—$H_2$ mixed gas, wherein a $H_2$ content is 0.5-20%; wherein a dew point of an annealing atmosphere is from −25° C. to 10° C.;

Then rapid cooling to 200-300° C. at a cooling rate ≥30° C./s;

Then reheating to 350-450° C. and holding for 60-250 s to obtain the cold-rolled high-strength steel plate having excellent phosphatability and formability.

Preferably, when the hot rolling in step 2) is performed, the temperature for reheating the slab is 1210-1270° C., and the coiling temperature is 450-550° C.

In addition, the soaking temperature in step 4) is 810-870° C.

Further, in step 4), the dew point of the annealing atmosphere is from −10° C. to 5° C.

The manufacture process of the disclosure is designed for the following reasons.

In the hot rolling according to the present disclosure, the temperature for reheating the slab is 1170-1300° C., preferably 1210-1270° C. If the heating temperature is too high, the slab will be over-fired, and the grain structure in the slab will be coarse. As a result, the thermal processability of the slab will be degraded. In addition, the ultra-high temperature will cause severe decarburization in the surface of the slab. If the heating temperature is too low, after the slab is descaled with high-pressure water and initially rolled, deformation resistance of the blank will be too large due to the excessively low finish rolling temperature. During the hot rolling, the holding time is set at 0.5-4 hours. If the holding time exceeds 4 hours, the grain structure in the slab will be coarse, and the surface of the slab will be decarburized seriously. If the holding time is less than 0.5 h, the internal temperature of the slab will not be uniform.

According to the present disclosure, it's necessary to control the final rolling temperature to be 850° C. or higher to complete the hot rolling of the cast slab. If the final rolling temperature is too low, the deformation resistance of the slab will be too high. Consequently, it will be difficult to produce a steel plate of a specified thickness, and the plate shape will be poor.

In the present disclosure, the hot rolled plate is coiled at 400-700° C., and the coiling temperature is preferably 450-550° C. If the coiling temperature is too high, the mill scale formed on the surface of the steel plate will be too thick to be pickled. If the coiling temperature is too low, the strength of the hot rolled coil will be rather high, such that the hot rolled coil will be difficult to be cold rolled, affecting production efficiency.

In the course of pickling according to the present disclosure, the pickling speed is ≤150 m/min. If the pickling speed is too fast, the mill scale on the surface of the steel plate cannot be removed completely, and surface defects will be formed easily. After pickling, the hot-rolled steel plate is cold rolled to deform it to a prescribed thickness, and the cold rolling reduction is 40-80%. A large cold rolling reduction can increase the austenite-forming rate in the subsequent annealing process. It helps to improve the uniformity of the structure of the annealed steel plate and thus improve the ductility of the steel plate. However, if the cold rolling reduction is too large, the deformation resistance of the material will be very high due to work hardening, so that it will be extremely difficult to prepare a cold-rolled steel plate having a prescribed thickness and a good plate shape.

In the annealing process according to the present disclosure, the soaking temperature is controlled at 790-920° C., and the soaking time is 30-200 s. The soaking temperature and the soaking time are selected mainly with an eye to their influence on the matrix structure and properties of the strip steel, as well as their influence on the thickness of the inner oxide layer in the surface layer of the steel plate. The rapid cooling temperature, the reheating temperature and the time of the reheating and holding are selected in hope of guaranteeing the residual austenite content in the steel plate to achieve the best formability. If the soaking temperature is lower than 790° C. and the soaking time is less than 30 s, austenization of the cold-rolled steel plate will not proceed sufficiently, and the austenite structure will not be homogeneous. After the subsequent annealing process, a sufficient amount of residual austenite cannot be formed, and the austenite is not stable enough. As a result, the final elongation of the steel plate is insufficient. If the soaking temperature is higher than 920° C. and the soaking time is longer than 200 s, the matrix structure of the steel plate will undergo complete austenitic transformation after the soaking treatment. The stability of the austenite will be reduced, so that the residual austenite content in the matrix of the steel plate will be decreased after annealing. At the same time, the thickness of the inner oxide layer formed in the surface layer of the steel plate after annealing will be greater than 5 μm, which will affect the toughness and formability of the steel plate.

In the rapid cooling stage according to the present disclosure, the rapid cooling temperature is controlled at 200-300° C., and the cooling rate is controlled at ≥30° C./s, so as to ensure that a certain amount of martensite structure can be produced in the steel plate. In the compositional design according to the present disclosure, the critical cooling rate of martensite is 30° C./s. Hence, in order to make sure that only the martensitic transformation occurs during the cooling process, the cooling rate is not less than 30° C./s. If the rapid cooling temperature is lower than 200° C., all austenite will undergo martensitic transformation. Then, no residual austenite will form in the room temperature structure of the steel plate. If the rapid cooling temperature is higher than 300° C., only a small amount of martensite will form, and the force that drives diffusion of the carbon contained in martensite into austenite is not enough in the subsequent reheating process, leading to insufficient stability of austenite. If the residual austenite content in the steel plate at room temperature is less than 5%, the formability of the steel plate will be affected.

The reheating temperature is controlled at 350-450° C., and the reheating time is 60-250 s according to the present disclosure. If the reheating temperature is lower than 350° C. and the reheating time is less than 60 s, the process for stabilizing the residual austenite in the steel plate will not proceed fully, and the content of the residual austenite in the room temperature structure will be less than 5%. If the reheating temperature is higher than 450° C. and the heating time is longer than 250 s, the steel plate will undergo significant temper softening, and the martensite strength will be reduced. Thus, the strength of the steel plate will be decreased.

According to the present disclosure, a $N_2$—$H_2$ mixed gas is employed for the annealing atmosphere of the heating and soaking stages, wherein the $H_2$ content is 0.5-20%, the purpose of which is to reduce the iron oxide in the surface of the strip steel. The dew point of the annealing atmosphere is from −25° C. to 10° C., preferably from −10° C. to 5° C. In the above ranges of the dew point, the annealing atmosphere is reductive for Fe, so that the iron oxide will be reduced. If the dew point of the annealing atmosphere is lower than −25° C., the above annealing atmosphere will still be oxidative for the Si element in the matrix, and Si in the matrix will form a continuous dense oxide film on the surface of the strip steel, and thus the phosphatability will be affected. If the dew point of the annealing atmosphere is higher than 10° C., the oxygen potential in the annealing atmosphere will be too high, and the ability of O atoms to diffuse into the matrix of the strip steel will be increased, leading to formation of an excessively thick inner oxide layer of alloy elements such as Si and Mn in the surface layer of the steel plate, which will affect the strength and formability of the steel plate. At the same time, Si and Mn begin to be enriched in the surface of the steel plate, so that the phosphatability of the steel plate will be deteriorated.

The present disclosure has the following beneficial effects in comparison with the prior art:

1) The surface layer of the cold-rolled high-strength steel plate of the present disclosure comprises an inner oxide layer which comprises iron as a matrix, has a thickness of 1-5 μm and contains oxide particles. The inner oxide layer prevents elements such as Si, Mn and the like from being enriched in the surface of the steel plate. Therefore, the oxidation reaction of the above elements does not occur on the surface of the steel plate, and the external oxidation is replaced by internal oxidation. No Si or Mn element is enriched in the surface of the steel plate, thereby improving the phosphatability of the steel plate and ensuring the excellent phosphatability of the high Si cold-rolled high-strength steel plate.

2) The cold-rolled high-strength steel plate of the present disclosure comprises residual austenite in its room temperature structure. During the deformation process, a certain amount of the residual austenite undergoes phase change and transforms into martensite, and the TRIP effect occurs, ensuring that the steel plate should have good formability while having a strength of 1180 MPa.

3) In the annealing process according to the present disclosure, the soaking temperature and the soaking time are selected mainly with an eye to their influence on the matrix structure and properties of the strip steel, as well as their influence on the thickness of the inner oxide layer in the surface layer of the steel plate. The rapid cooling temperature, the reheating temperature and the time of the reheating and holding are selected in hope of guaranteeing the residual austenite content in the steel plate to achieve the best formability.

4) In the annealing process according to the disclosure, a $N_2$—$H_2$ mixed gas is employed for the annealing atmosphere of the heating and soaking stages, wherein the $H_2$ content is 0.5-20%, so as to reduce the iron oxide in the surface of the strip steel. The dew point of the annealing atmosphere is from −25° C. to 10° C. In the above range of the dew point, the selected annealing atmosphere is reductive for Fe, so that the iron oxide will be reduced. At the same time, external oxidation and enrichment of oxidizable elements such as Si, Mn and the like in the surface of the steel plate will be suppressed. The external oxidation will turn into internal oxidation, and an inner oxide layer having a thickness of 1-5 μm will be formed in the surface layer.

5) The present disclosure can be effected on an existing continuous annealing production line for high-strength steel, with no need for big adjustment. The cold-rolled high-strength steel plate of the present disclosure has a promising prospect of application in automobile structural parts, particularly suitable for manufacture of automobile structural parts and safety parts having complex shapes and high requirements for formability and corrosion resistance, such as door impact beams, bumpers and B-pillars.

DETAILED DESCRIPTION

The present disclosure will be further explained and illustrated with reference to the accompanying drawings and the specific examples. Nonetheless, the explanation and illustration are not intended to unduly limit the technical solution of the present disclosure.

EXAMPLES AND COMPARATIVE EXAMPLES

Cold-rolled high-strength steel plates having excellent phosphatability and formability in Examples 1-16 according to the present disclosure and steel plates in Comparative Examples 1-5 were obtained by the following steps:

Table 1 lists the mass percentages (%) of the chemical elements in Examples 1-16 and Comparative Examples 1-5, with the rest being Fe.

A steel material having a composition shown in Table 1 was smelted and cast to form a slab. The slab was heated at a heating temperature of 1250° C. and held for 1 h, followed by hot rolling. Finish rolling was fulfilled at a final rolling temperature of 900° C. or higher. The hot-rolled steel plate had a thickness of about 2.5 mm. The hot-rolled steel plate was coiled at 500° C., pickled and cold-rolled with a cold rolling reduction of 52%. The final thickness of the rolled hard strip steel was 1.2 mm.

The resulting rolled hard strip steel was uncoiled, cleaned, and annealed, wherein the annealing process and atmosphere conditions employed in the Examples and Comparative Examples are shown in Table 2. Then, the annealed, cold-rolled high-strength steel plates were evaluated for mechanical properties, residual austenite content, inner oxide layer thickness in the surface layer, average diameter of oxide particles, average spacing between particles and phosphatability, and the evaluation results are shown in Table 3.

Figure 1:
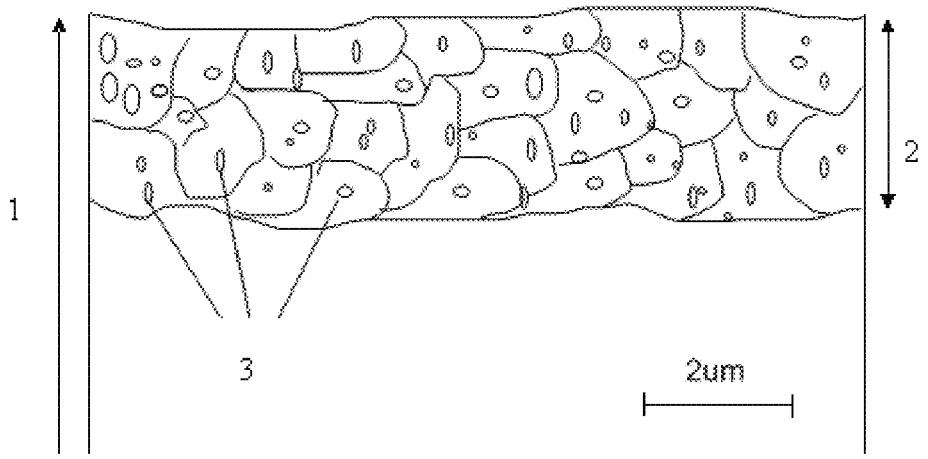
FIG. 1 is a schematic view showing an inner oxide layer in a surface of a cold-rolled high-strength steel plate according to the present disclosure, wherein 1 represents a steel plate, 2 represents an inner oxide layer, and 3 represents oxide particles.
Figure 2:
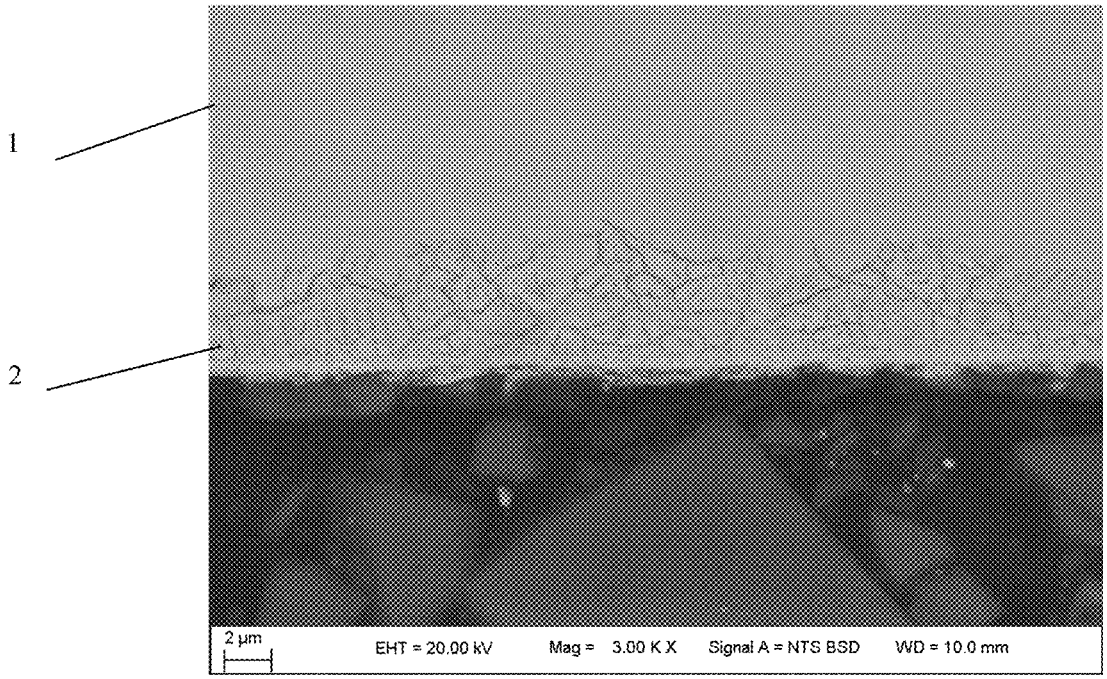
FIG. 2 is an SEM (scanning electron microscopy) backscattered electron image of a cross-section of a cold-rolled high-strength steel plate according to an embodiment of the present disclosure, wherein 1 represents a steel plate, and 2 represents an inner oxide layer in the surface layer of the steel plate.
Figure 3:
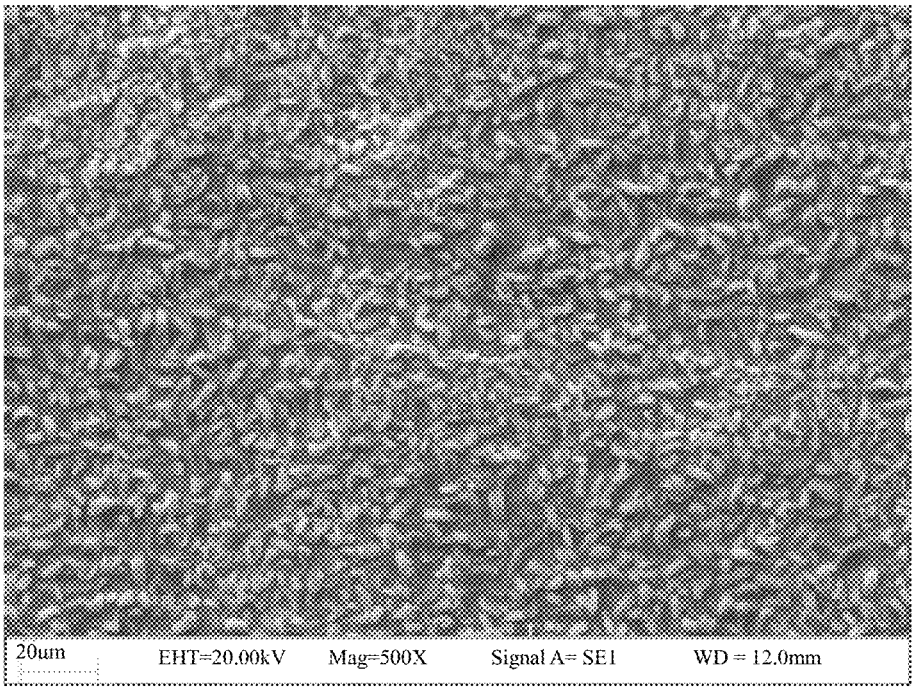
FIG. 3 is an SEM secondary electron image of a surface of a phosphated cold-rolled high-strength steel plate according to an embodiment of the present disclosure.

As can be seen from Table 3, all the Examples with the annealing process of the present disclosure used had a tensile strength of 1180 MPa or higher, an elongation of 14% or higher, and a residual austenite content of no less than 5% in the room temperature structure and had good formability. At the same time, by controlling the dew point of the annealing atmosphere, a 1-5 μm inner oxide layer existed in the surface layer of the steel plate. The characteristics of the inner oxide layer are shown in FIGS. 1-2. After phosphating, the phosphated crystals covered the surface of the steel plate uniformly, and the crystal size was less than 10 μm, wherein the coverage area exceeded 80%, indicating excellent phosphatability, as shown by FIG. 3.

Figure 4:
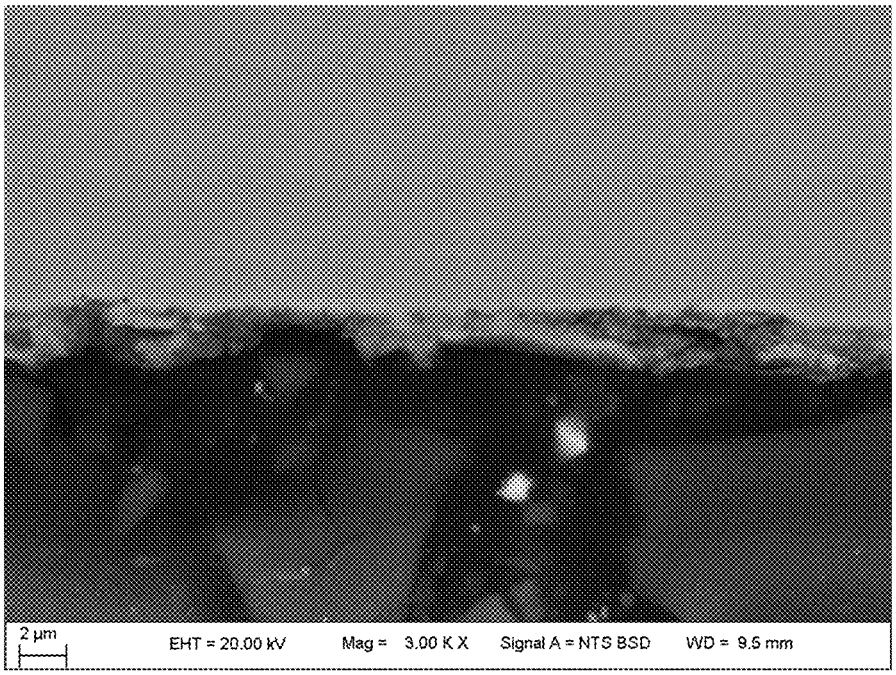
FIG. 4 is an SEM backscattered electron image of a cross-section of a cold-rolled high-strength steel plate of Comparative Example 1.
Figure 5:
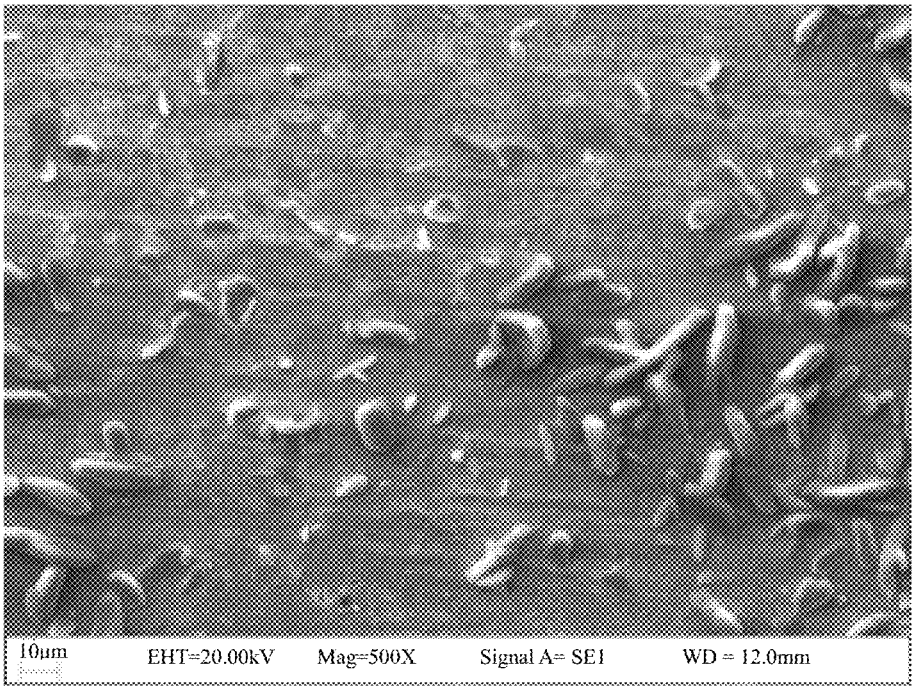
FIG. 5 is an SEM secondary electron image of a surface of a phosphated cold-rolled high-strength steel plate of Comparative Example 1.

As known from a combination of Tables 2 and 3, the dew point of Comparative Example 1 was −40° C., far lower than the lower limit designed by the present disclosure, and no inner oxide layer was formed in the surface (see FIG. 4). Instead, Si and Mn were enriched in the surface of the steel plate. Therefore, after phosphating of the steel plate, phosphated crystals only appeared in local areas of the surface, the crystal size was large, and most of the surface was not covered by phosphated crystals, indicating poor phosphatability, as shown by FIG. 5.

The rapid cooling temperature of Comparative Example 2 was 100° C., wherein the austenite was all transformed into martensite, and thus there was no residual austenite. Therefore, the strength of the steel plate was rather high, and the elongation was rather low.

The soaking temperature of Comparative Example 3 was 755° C., lower than 790° C. required by the design. In the soaking process, austenization was not sufficient. In the subsequent cooling and heating processes, residual austenite couldn't be stabilized in a sufficient amount. Therefore, the strength and elongation of the material were rather low.

In Comparative Example 4, due to the use of a dew point exceeding the upper limit designed by the present disclosure, the inner oxide layer in the surface of the steel plate was rather thick, which affected the tensile strength and elongation of the material. At the same time, the excessively high dew point caused reenrichment of Si and Mn elements in the surface of the steel plate. As a result, the phosphatability of the steel plate began to deteriorate again.

As known from a combination of Tables 1 and 3, the silicon content of Comparative Example 5 was rather low, and its elongation was unable to reach 14%. This is because the Si content did not reach the designed lower limit. Therefore, during the annealing process, the content of the residual austenite was insufficient, resulting in a low elongation.

Tensile test method was as follows: A No. 5 tensile test specimen under JIS was used, and the tensile direction was perpendicular to the rolling direction.

Method of measuring a residual austenite content: A specimen of 15×15 mm in size was cut from a steel plate, ground, polished, and tested quantitatively using XRD.

Steel plates were sampled along their cross-sections. After grinding and polishing, the cross-sectional morphologies were observed for all the steel plate samples at a magnification of 5000 times under a scanning electron microscope.

Method of measuring an average diameter and an average spacing of oxide particles in an oxide layer: A steel plate was sampled along its cross-section. After grinding and polishing, 10 fields of view were observed randomly at a magnification of 10000 times under a scanning electron microscope, and an image software was used to calculate the average diameter and average spacing of the oxide particles.

Method of evaluating phosphatability of a steel plate: An annealed steel plate was subjected to degreasing, water washing, surface conditioning and water washing in order, and then phosphated, followed by water washing and drying. The phosphated steel plate was observed in 5 random fields of view at a magnification of 500 times under a scanning electron microscope, and an image software was used to calculate the area not covered by the phosphated film. If the uncovered area was less than 20% and the phosphated crystal size was less than 10 μm, the phosphatability was judged to be good (OK); and conversely, the phosphatability was judged to be poor (NG).

It is to be noted that there are listed above only specific examples of the invention. Obviously, the invention is not limited to the above examples. Instead, there exist many similar variations. All variations derived directly or envisioned from the present disclosure by those skilled in the art should be all included in the protection scope of the present disclosure.

TABLE 1

| No. | C | Si | Mn | P | S | Al | N | Cr | Mo | Ti | Nb | V |
|---|---|---|---|---|---|---|---|---|---|---|---|---|
| A | 0.16 | 1.6 | 2.5 | 0.009 | 0.003 | 0.045 | 0.0057 | 0.5 | — | 0.02 | — | — |
| B | 0.23 | 1.5 | 2.9 | 0.015 | 0.004 | 0.033 | 0.0037 | — | 0.1 | — | 0.03 | — |
| C | 0.18 | 1.7 | 2.5 | 0.01 | 0.006 | 0.04 | 0.0065 | 0.2 | 0.15 | — | — | 0.05 |
| D | 0.2 | 1.8 | 2.3 | 0.008 | 0.007 | 0.052 | 0.0043 | — | 0.2 | 0.015 | 0.015 | — |
| E | 0.14 | 1.2 | 2.3 | 0.011 | 0.002 | 0.032 | 0.0023 | — | 0.05 | — | 0.015 | 0.025 |

TABLE 2

| | | Annealing Process | | | | | |
|---|---|---|---|---|---|---|---|
| No. | Composition | Dew point of annealing atmosphere (° C.) | Soaking temperature (° C.) | Soaking time (s) | Rapid cooling temperature (° C.) | Reheating temperature (° C.) | Reheating time (s) |
| Ex. 1 | A | −15 | 840 | 120 | 250 | 375 | 240 |
| Ex. 2 | A | −10 | 875 | 100 | 220 | 400 | 60 |
| Ex. 3 | A | 10 | 822 | 55 | 280 | 420 | 120 |
| Ex. 4 | A | 3 | 800 | 150 | 200 | 393 | 170 |
| Ex. 5 | B | 7 | 902 | 60 | 260 | 405 | 150 |
| Ex. 6 | B | −11 | 834 | 100 | 240 | 390 | 103 |
| Ex. 7 | B | −2 | 796 | 180 | 292 | 430 | 208 |
| Ex. 8 | B | 0 | 850 | 120 | 245 | 410 | 180 |
| Ex. 9 | C | −10 | 810 | 125 | 235 | 403 | 140 |
| Ex. 10 | C | −14 | 869 | 84 | 275 | 442 | 220 |
| Ex. 11 | C | 5 | 893 | 105 | 290 | 385 | 167 |
| Ex. 12 | C | 10 | 827 | 200 | 228 | 400 | 160 |
| Ex. 13 | D | 0 | 805 | 140 | 210 | 405 | 100 |
| Ex. 14 | D | −10 | 904 | 79 | 240 | 394 | 235 |
| Ex. 15 | D | −10 | 845 | 104 | 283 | 420 | 127 |
| Ex. 16 | D | −5 | 820 | 197 | 255 | 368 | 80 |
| Comp. Ex. 1 | A | −40 | 832 | 90 | 270 | 410 | 100 |
| Comp. Ex. 2 | B | −20 | 840 | 100 | 150 | 390 | 90 |

TABLE 2-continued

| No. | Composition | Annealing Process: Dew point of annealing atmosphere (° C.) | Soaking temperature (° C.) | Soaking time (s) | Rapid cooling temperature (° C.) | Reheating temperature (° C.) | Reheating time (s) |
|---|---|---|---|---|---|---|---|
| Comp. Ex. 3 | C | −10 | 755 | 120 | 260 | 375 | 170 |
| Comp. Ex. 4 | D | 15 | 900 | 105 | 280 | 425 | 20 |
| Comp. Ex. 5 | E | 0 | 850 | 60 | 240 | 405 | 200 |

TABLE 3

| No. | Composition | Mechanical Properties: YS (MPa) | TS (MPa) | TEL (%) | Thickness of Inner Oxide Layer (μm) | Oxide Particle Diameter (nm) | Average Interparticle Spacing (nm) | Residual Austenite Content (%) | Phosphatability |
|---|---|---|---|---|---|---|---|---|---|
| Ex. 1 | A | 920 | 1212 | 16.2 | 1.5 | 50 | 73 | 10 | OK |
| Ex. 2 | A | 975 | 1244 | 14.1 | 3.1 | 168 | 245 | 7 | OK |
| Ex. 3 | A | 830 | 1206 | 18.1 | 2.9 | 152 | 222 | 12 | OK |
| Ex. 4 | A | 817 | 1195 | 17.4 | 2.3 | 148 | 216 | 8 | OK |
| Ex. 5 | B | 1127 | 1370 | 14.5 | 4.2 | 191 | 286 | 6 | OK |
| Ex. 6 | B | 1038 | 1289 | 15.3 | 1.8 | 140 | 210 | 7 | OK |
| Ex. 7 | B | 806 | 1211 | 14.7 | 2.3 | 135 | 202 | 5 | OK |
| Ex. 8 | B | 1079 | 1293 | 15.1 | 2.1 | 114 | 171 | 7 | OK |
| Ex. 9 | C | 872 | 1191 | 17 | 1.7 | 128 | 189 | 9 | OK |
| Ex. 10 | C | 1010 | 1203 | 15.8 | 1.6 | 150 | 222 | 10 | OK |
| Ex. 11 | C | 1050 | 1237 | 14.6 | 3.7 | 185 | 274 | 8 | OK |
| Ex. 12 | C | 903 | 1196 | 17.2 | 3.5 | 178 | 263 | 9 | OK |
| Ex. 13 | D | 880 | 1224 | 15.2 | 2.4 | 110 | 162 | 8 | OK |
| Ex. 14 | D | 1083 | 1258 | 14.5 | 2.5 | 167 | 245 | 6 | OK |
| Ex. 15 | D | 975 | 1243 | 16.1 | 1.9 | 80 | 118 | 10 | OK |
| Ex. 16 | D | 902 | 1219 | 17.2 | 2.3 | 121 | 178 | 11 | OK |
| Comp. Ex. 1 | A | 850 | 1172 | 15.2 | 0 | 0 | 0 | 6 | NG |
| Comp. Ex. 2 | B | 1142 | 1407 | 11.6 | 1.5 | 61 | 127 | 0 | OK |
| Comp. Ex. 3 | C | 790 | 1162 | 13.1 | 1.1 | 72 | 73 | 3 | OK |
| Comp. Ex. 4 | D | 1082 | 1279 | 12.8 | 8.2 | 389 | 32 | 5 | NG |
| Comp. Ex. 5 | E | 976 | 1177 | 10.9 | 2.2 | 102 | 87 | 3 | OK |

What is claimed is:

1. A cold-rolled high-strength steel plate having excellent phosphatability and formability, comprising chemical elements in percentage by mass of: C 0.15 to 0.25%, Si 1.50 to 2.50%, Mn 2.00 to 3.00%, P≤0.02%, S≤0.01%, Al 0.03 to 0.06%, N≤0.01%, and a balance of Fe and unavoidable impurity elements, wherein a surface layer of the steel plate comprises an inner oxide layer having a thickness of 1 to 5 μm; the inner oxide layer comprises iron as a matrix; the matrix comprises oxide particles which are at least one of oxides of Si, composite oxides of Si and Mn; no Si or Mn element is enriched in the surface;

the oxide particles have an average diameter of 50 to 200 nm and an average spacing λ between the oxide particles satisfying the following relationship:

$$A=0.247\times(0.94\times[Si]+0.68\times[Mn])^{1/2}\times d$$

$$B=1.382\times(0.94\times[Si]+0.68\times[Mn])^{1/2}\times d$$

$$A\leq\lambda\leq B$$

wherein [Si] is the content % of Si in the steel; [Mn] is the content % of Mn in the steel; and d is the diameter of the oxide particles in nm;

wherein the cold-rolled high-strength steel plate having excellent phosphatability and formability comprises a room temperature structure consisting of a composite structure of ferrite, martensite and residual austenite, and wherein the residual austenite has a content of no less than 5%;

wherein after phosphating, crystals resulted from the phosphating covered the surface of the steel plate uniformly, and the crystal size is less than 10 μm, wherein the coverage area exceeds 80%; and wherein the cold-rolled high-strength steel plate has a tensile strength ≥1180 MPa, and an elongation ≥14%.

2. The cold-rolled high-strength steel plate having excellent phosphatability and formability according to claim 1, wherein the steel plate further comprises at least one of Cr 0.01 to 1.0%, Mo 0.01 to 0.5% and Ni 0.01 to 2.0%, and/or further comprises at least one of Ti 0.005 to 0.05%, Nb 0.005 to 0.1% and V 0.005 to 0.1%.

3. The cold-rolled high-strength steel plate having excellent phosphatability and formability according to claim 1, wherein the oxide particles are at least one of silicon dioxide ($SiO_2$), manganese silicate, iron silicate and ferromanganese silicate.

4. A manufacturing method for the cold-rolled high-strength steel plate having excellent phosphatability and formability according to claim 1, comprising the following steps:

1) Smelting and casting

Smelting and casting according to said chemical composition to form a slab;

2) Hot rolling and coiling

Heating the slab to 1170-1300° C.; holding for 0.5-4 h; rolling, with a final rolling temperature ≥850° C.; and coiling at a coiling temperature of 400-700° C. to obtain a hot rolled coil;

3) Pickling and cold rolling

Uncoiling the hot rolled coil, pickling at a speed ≤150 m/min, and cold rolling with a cold rolling reduction of 40-80% to obtain a rolled hard strip steel;

4) Continuous Annealing

Uncoiling the resulting rolled hard strip steel, cleaning, heating to a soaking temperature of 790-920° C., and holding for 30-200 s, wherein a heating rate is 1-20° C./s, and an atmosphere of the heating and holding stages is a $N_2$—$H_2$ mixed gas, wherein a $H_2$ content is 0.5-20%; wherein a dew point of an annealing atmosphere is from −25° C. to 10° C.;

then rapid cooling to 200-300° C. at a cooling rate ≥30° C./s;

then reheating to 350-450° C. and holding for 60-250 s to obtain the cold-rolled high-strength steel plate having excellent phosphatability and formability.

5. The manufacturing method for the cold-rolled high-strength steel plate having excellent phosphatability and formability according to claim 4, wherein when the hot rolling in step 2) is performed, the temperature for reheating the slab is 1210-1270° C., and the coiling temperature is 450-550° C.

6. The manufacturing method for the cold-rolled high-strength steel plate having excellent phosphatability and formability according to claim 4, wherein in step 4), the soaking temperature is 810-870° C., and the dew point of the annealing atmosphere is from −10° C. to 5° C.

7. The cold-rolled high-strength steel plate having excellent phosphatability and formability according to claim 2, wherein the oxide particles are at least one of silicon dioxide ($SiO_2$), manganese silicate, iron silicate and ferromanganese silicate.

8. The manufacturing method for the cold-rolled high-strength steel plate having excellent phosphatability and formability according to claim 5, wherein in step 4), the soaking temperature is 810-870° C., and the dew point of the annealing atmosphere is from −10° C. to 5° C.

9. The manufacturing method for the cold-rolled high-strength steel plate having excellent phosphatability and formability according to claim 4, wherein the steel plate further comprises at least one of Cr 0.01 to 1.0%, Mo 0.01 to 0.5% and Ni 0.01 to 2.0%, and/or further comprises at least one of Ti 0.005 to 0.05%, Nb 0.005 to 0.1% and V 0.005 to 0.1%.

10. The manufacturing method for the cold-rolled high-strength steel plate having excellent phosphatability and formability according to claim 4, wherein the oxide particles are at least one of silicon oxide, manganese silicate, iron silicate and ferromanganese silicate.

* * * * *